US006435580B1

(12) United States Patent
Lock

(10) Patent No.: US 6,435,580 B1
(45) Date of Patent: Aug. 20, 2002

(54) HAND-HELD SHOVEL

(76) Inventor: Willie Lock, 1303 Kingston Street, Calgary (CA), T2N 3X9

( * ) Notice: Subject to any disclaimer, the term of this patent is extended or adjusted under 35 U.S.C. 154(b) by 0 days.

(21) Appl. No.: 09/819,756

(22) Filed: Mar. 29, 2001

(51) Int. Cl.[7] ..... E01H 5/02
(52) U.S. Cl. ..... 294/54.5; 37/284
(58) Field of Search ..... 294/51, 52, 53.5, 294/54.5, 57, 58; 37/241, 265, 266, 268, 270, 279, 284, 285; 56/400.01, 400.06; 172/381

(56) References Cited

U.S. PATENT DOCUMENTS

| | | | | | |
|---|---|---|---|---|---|
| 841,848 | A | * | 1/1907 | Conner | 294/54.5 X |
| 1,202,791 | A | * | 10/1916 | Brownstein | 294/54.5 X |
| 1,511,073 | A | * | 10/1924 | Gampher | 37/285 X |
| 2,098,609 | A | * | 11/1937 | Bishop | 294/53.5 X |
| 2,463,150 | A | * | 3/1949 | Camp | 294/54.5 X |
| 2,513,230 | A | * | 6/1950 | Bourne et al. | 37/284 |
| 2,715,786 | A | * | 8/1955 | Dorko | 37/284 X |
| 2,785,483 | A | * | 3/1957 | Gajewski | 37/284 |
| 2,896,993 | A | | 7/1959 | Pollock | |
| 2,919,153 | A | | 12/1959 | Benton | |
| 3,727,964 | A | * | 4/1973 | Nordvik | 294/54.5 X |
| 4,199,181 | A | | 4/1980 | Mason | |
| 4,550,943 | A | * | 11/1985 | Mirto | 294/54.5 |
| 4,947,562 | A | * | 8/1990 | Williamson | 294/545 X |
| 5,159,769 | A | | 11/1992 | Odorisio | |
| 5,511,328 | A | | 4/1996 | Fingerer et al. | |
| 5,727,829 | A | * | 3/1998 | Bellichak | 294/54.5 X |
| 5,829,808 | A | | 11/1998 | Colla | |
| 5,975,602 | A | * | 11/1999 | Zan | 294/54.5 |
| 6,053,548 | A | | 4/2000 | Bowles, Jr. | |

FOREIGN PATENT DOCUMENTS

| | | |
|---|---|---|
| GB | 2137266 A | 10/1984 |
| GB | 2242466 A | 10/1991 |
| JP | 8173589 | 7/1996 |

* cited by examiner

*Primary Examiner*—Johnny D. Cherry
(74) *Attorney, Agent, or Firm*—Borden Ladner Gervais LLP; Andrew R. Hicks

(57) ABSTRACT

The invention relates to a shovel particularly useful for snow removal. The shovel is characterized by dual ground contacting edges allowing the shovel to be self-supporting and which allows the shovel to be used in an ergonomically efficient manner for removing snow from a surface.

19 Claims, 6 Drawing Sheets

HAND-HELD SHOVEL

FIELD OF THE INVENTION

The invention relates to a shovel particularly useful for snow removal. The shovel is characterized by dual ground contacting edges allowing the shovel to be self-supporting and which allows the shovel to be used in an ergonomically efficient manner for removing snow from a surface.

BACKGROUND OF THE INVENTION

Snow removal shovels are well known. Various types of shovels have been used and developed over the years for particular uses or applications. For example, shovels having specialized handles and blades have been developed for lifting snow whereas other shovels have specifically been developed for pushing or plowing snow. In other shovels, particular aspects of the handles or blades have been designed in an attempt to improve the ergonomics and/or efficiencies of using the shovel.

While particular shovels have been designed with improved ergonomics and/or efficiencies of use, for particular applications, such as the clearing of walkways or driveways, shovels have not always enabled ergonomically efficient methodologies for the clearing of snow from a surface. In particular, past shovels have required either the lifting of a snow-laden shovel from the surface and carrying or throwing the snow away or pushing the snow in a manner that is ergonomically inefficient. These inefficiencies are particularly relevant to physically weaker persons, such as the elderly, who as a result of these inefficiencies may cause harm to themselves through the use of a shovel thereby giving themselves back problems, muscle strains or increasing the risk of heart attack through over-exertion. Such risks of harm may cause these people to be hesitant to make the effort to clear snow from their driveways or walkways which may lead to dangerous accumulations of snow and the resulting risk of slip and fall injuries.

Furthermore, past shovels are not self-supporting during non-use. That is, in order for a user to retrieve a shovel for use that is lying flat on the ground requires the user to bend over to lift the shovel or, alternatively retrieve the shovel from against a wall that the shovel may have been leaned against. Similarly, after use, past shovels must be returned to a supporting wall and carefully balanced against the wall or allowed to drop to the ground. Leaning shovels against a wall is often unstable with the result that the shovel may slip causing other shovels or similarly positioned implements to crash to the floor of a garage, shed or storage room. This is not only inconvenient but may also result in damage to cars or other stored equipment.

Still further, in snowy regions, shovels are often jammed into a snowbank by a user in order to support the shovel during or after use. Very often, the shovel will fall over and become lost beneath new snow as it falls thereby increasing the risk of damage by a vehicle running it over or simply inconveniencing a user by it not being available when needed.

Accordingly, there has been a need for a shovel which allows for the pushing of snow in an ergonomically efficient manner and which is self-supporting.

Examples of past shovels which provide various operational features are described. For example, U.S. Pat. No. 6,053,548 discloses a manually operable combination shovel and plow; U.S. Pat. No. 5,829,808 discloses an adjustable angle snow plow; U.S. Pat. No. 2,919,153 discloses a combination snow shovel and plow tool; U.S. Pat. No. 4,199,181 discloses a snow shovel having a diagonal curve; U.S. Pat. No. 2,896,993 discloses a snow shovel having an adjustable blade; U.S. Pat. No. 5,159,769 discloses a combination snow shovel and plow; U.S. Pat. No. 5,159,769 discloses a shovel having shovel and plow characteristics and; U.S. Pat. No. 5,511,328 discloses a snow plow having adjustable blades. In particular, none of the devices described in these patents is self-supporting.

SUMMARY OF THE INVENTION

In accordance with the invention, there is provided a shovel comprising:

a blade having first and second ground contacting edges;

a handle operatively connected to the blade wherein the handle and blade allow pushing operation of the shovel with either of the first or second ground contacting edges in contact with the ground.

In a more specific embodiment, the invention provides a self-supporting shovel comprising:

a blade having first and second ground contacting edges and any one of or a combination of a semi-circular, semi-elliptical -or parabolic cross-section;

a handle operatively connected to and angled with respect to the blade wherein the handle and blade allow pushing operation of the shovel with either of the first or second ground contacting edges in contact with the ground.

DESCRIPTION OF THE DRAWINGS

These and other features of the invention are described with reference to the drawings wherein.

DETAILED DESCRIPTION OF THE INVENTION

With reference to the Figures, a shovel 10 having a blade 12 and handle 14 is described. The shovel 10 is particularly adapted for pushing material such as snow in a manner similar to that of a snowplow. While the shovel is particularly adapted for pushing snow, it is understood that other materials may be pushed by the shovel and, accordingly, reference to snow is not meant to be limiting to the scope of interpretation of the uses of the shovel.

Figure 1:
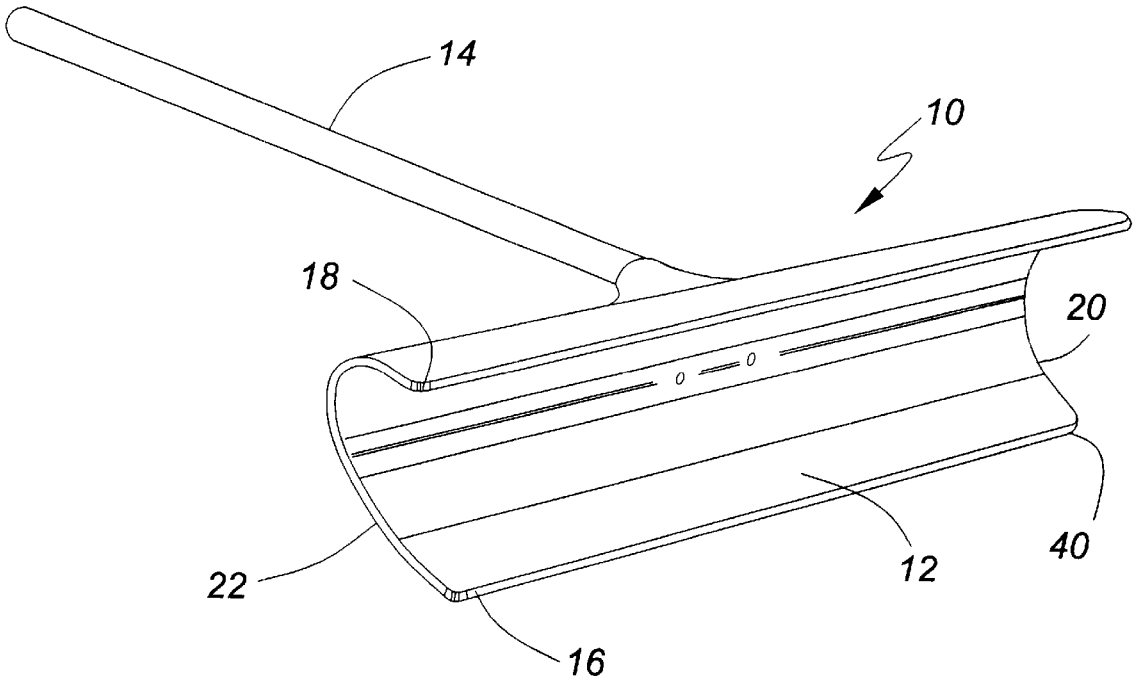
FIG. 1 is an isometric view of the shovel in accordance with one embodiment of the invention.
Figure 2:
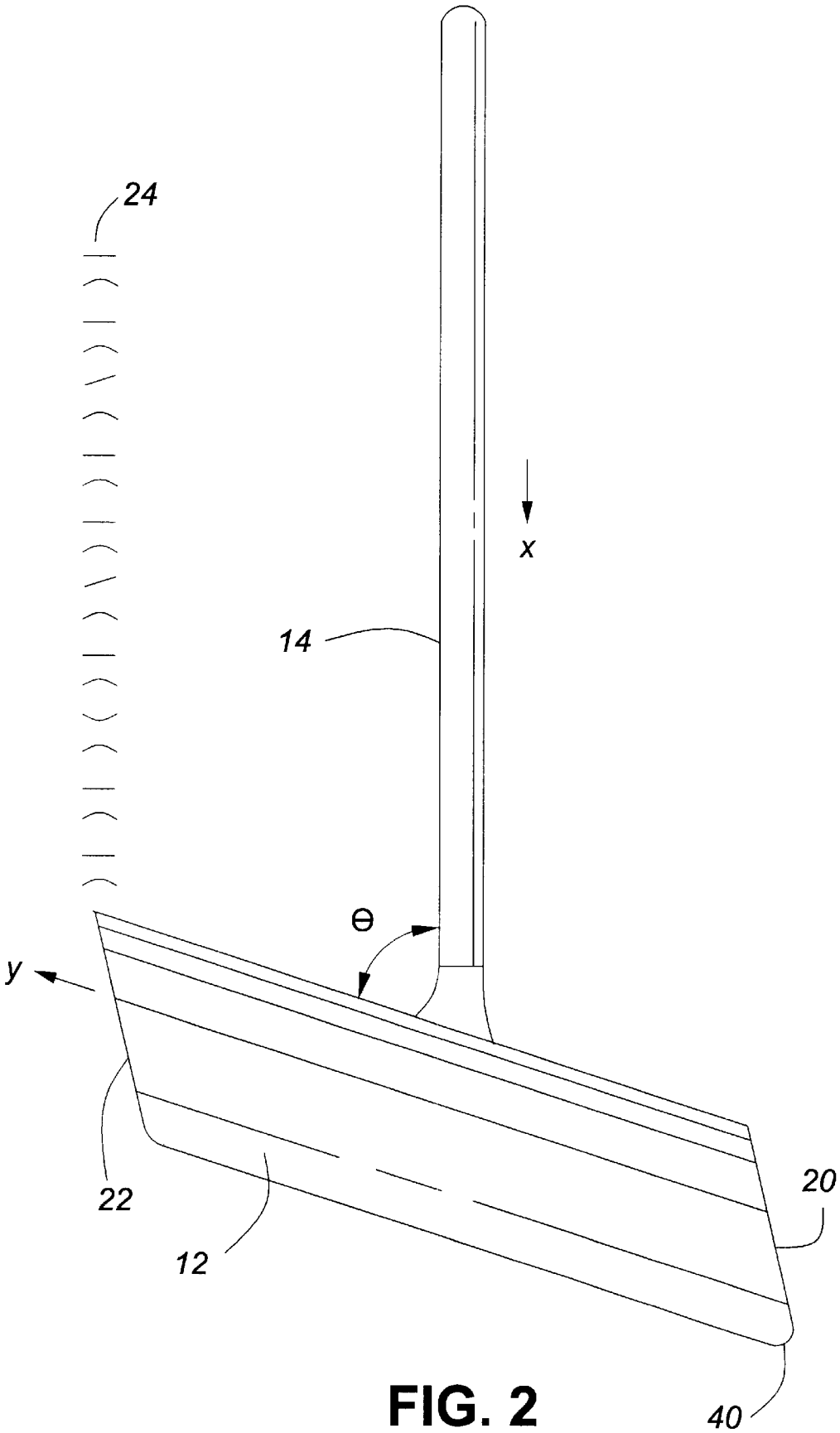
FIG. 2 is a plan view of the shovel in accordance with one embodiment of the invention.
Figure 3:
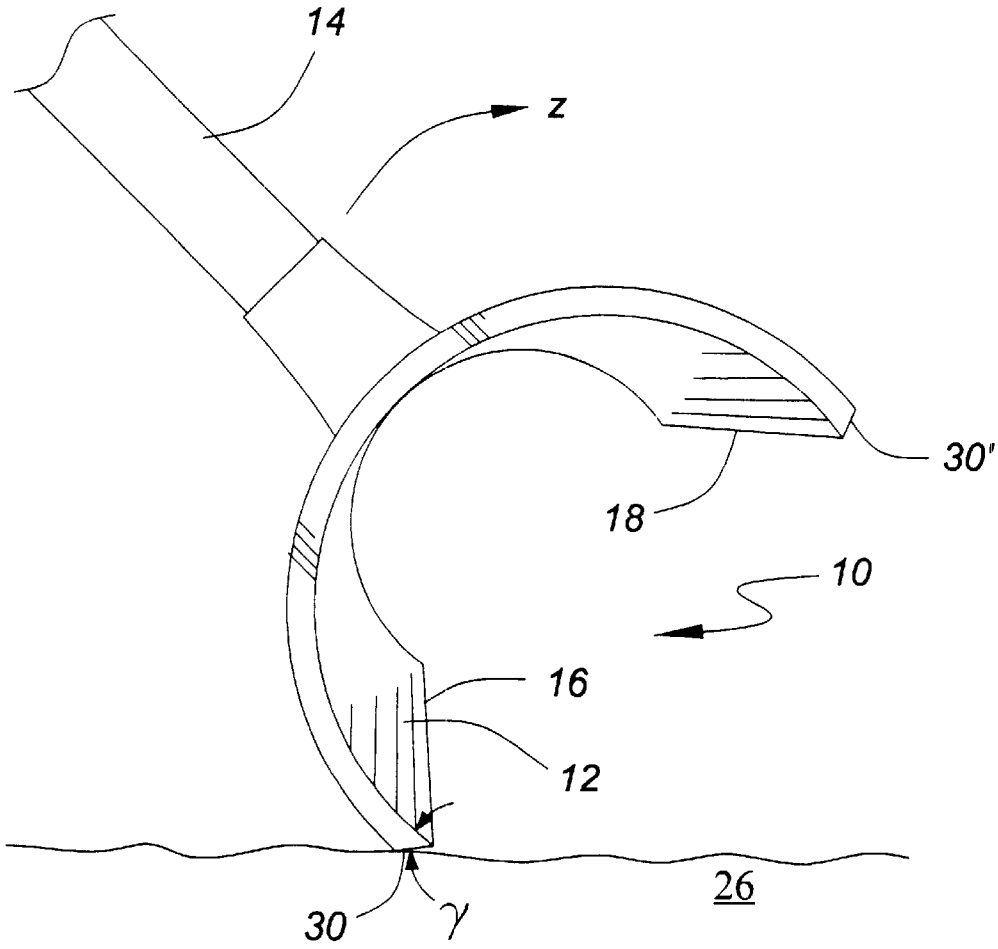
FIG. 3 is a side view of the shovel in accordance with one embodiment of the invention.
Figure 4:
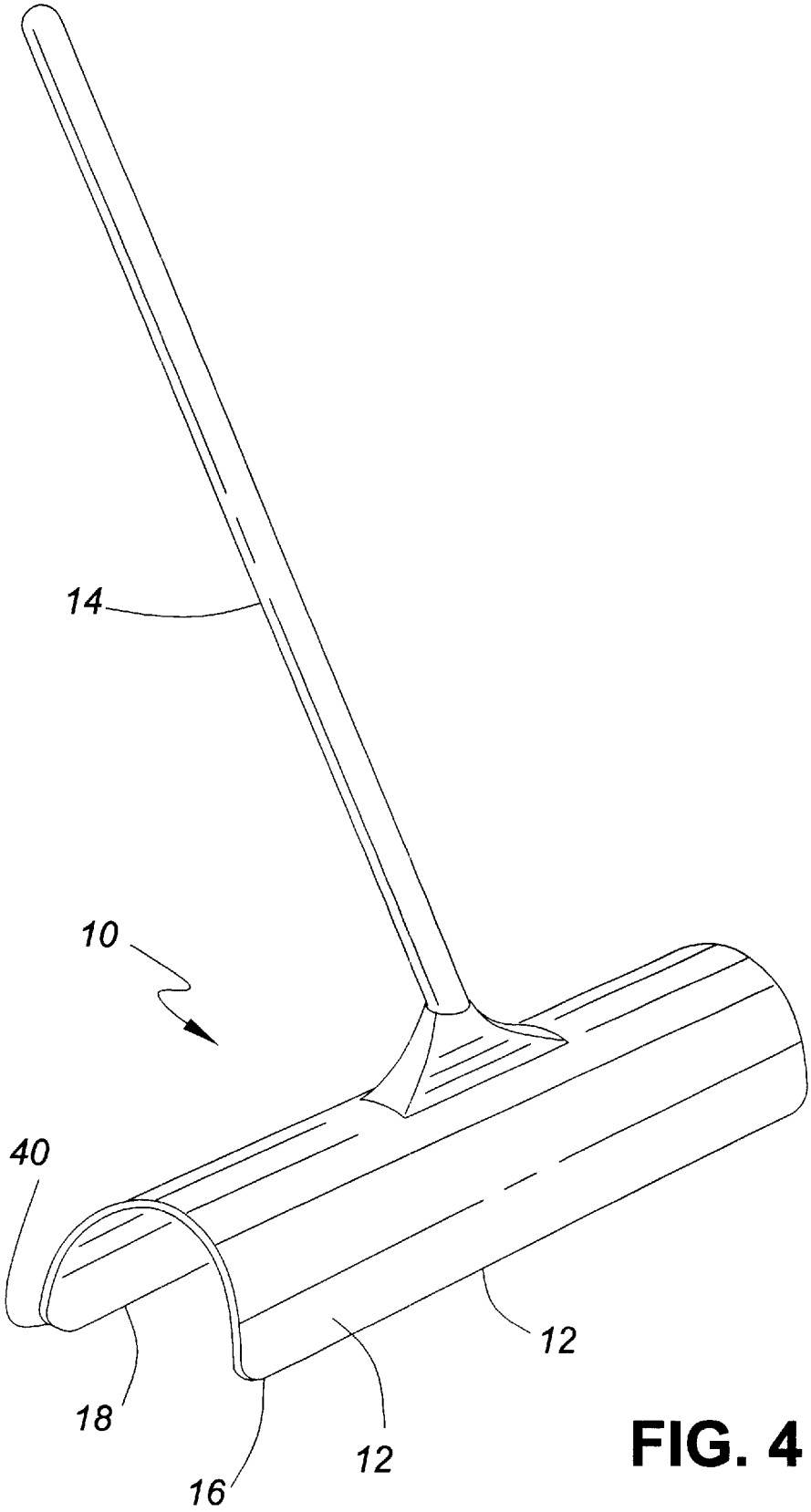
FIG. 4 is a perspective view of a shovel in accordance with one embodiment of the invention in a stored and upright position.

The blade 12 of the shovel 10 is generally semi-cylindrical as shown in FIGS. 1, 3 and 4 with the blade 12 having first and second ground contacting edges 16 and 18. In other embodiments, the blade 12 may be semi-elliptical or parabolic in cross-section. As shown, it is preferred that the handle projects outwardly from the convex surface of the blade 12 midway between the first and second ground contacting edges 16 and 18 and midway between a leading end 20 and trailing end 22 of the blade 12. As shown in FIG. 2, it is also preferred that the handle is angled with respect to the blade 12 as denoted by θ.

The shovel 10 is particularly adapted to clear snow on surfaces such as driveways and walkways. In normal operation, the user would initiate the snow clearing routine at one edge or in the middle of the driveway or walkway. By engaging the first ground contacting edge 16 against the driveway or walkway and by pushing the handle in a desired direction x (normally parallel to one edge of the driveway or walkway), snow is collected by the blade and ejected from the blade at trailing end 22 in a direction y. The ejection of the snow is a result of the angle θ between the blade and the handle and the forward motion of the shovel 10. More specifically, as snow encounters the inner concave surface of the blade 12, it rises up the inner surface of the blade 12 to a position at which gravity causes the rising snow to fall and be deflected towards the trailing end 22 at which position it exits the shovel 10. The ejected snow results in a berm 24 of snow generally parallel to the direction of travel x and the area of the driveway or walkway beneath the blade has been cleared of snow. The handle would typically be held by the user at an angle of approximately 30–60 degrees with respect to the horizontal as shown in FIG. 3.

The user, upon reaching the end of the driveway or walkway would reverse the direction of travel and by rotating the blade of the shovel in a direction z (FIG. 3) would place the second ground contacting edge 18 against the driveway or walkway. With both ground contacting edge 16 and ground contacting edge 18 on the driveway/walkway surface 26, the shovel 10 would be in a self-supporting position. By stepping over or around the shovel 10, the handle 14 would be continued to be rotated in the direction z in order to lift the first ground contacting edge 16 from the surface 26. Thereafter, and by orienting the handle in order that it is parallel to the berm 24 and the leading end 20 is adjacent and aligned with the berm 24, the user pushes the shovel in a direction parallel to the berm 24 so as to continue the ejection of snow from the trailing end 22. By successively repeating passes as described above, the user can effectively cause the movement of snow from the driveway or walkway to a location lateral to the driveway or walkway without lifting the shovel 10 from the surface. It is understood that the actual use of the shovel will depend on snow conditions with the specific actions of the user being modified to the specific conditions.

During non-use or storage, the shovel is self-supporting when placed on its first and second ground contacting edges 16, 18 as shown in FIG. 4.

In order to maximize the efficiency of the use of the shovel 10, the first and second ground contacting edges 16, 18 of the blade 12 are provided with a bevelled edge 30, 30' to promote the blade's snow lifting or scraping action close to the ground. That is, by providing a bevel, the edge of the shovel 10 is made sharper in order to promote dislodging compacted snow or ice from the ground. The angle of bevel, γ, is preferably in the order of 45 degrees in order to correspond to the average angle of the handle 14 with respect to the horizontal during use.

Figure 3A:
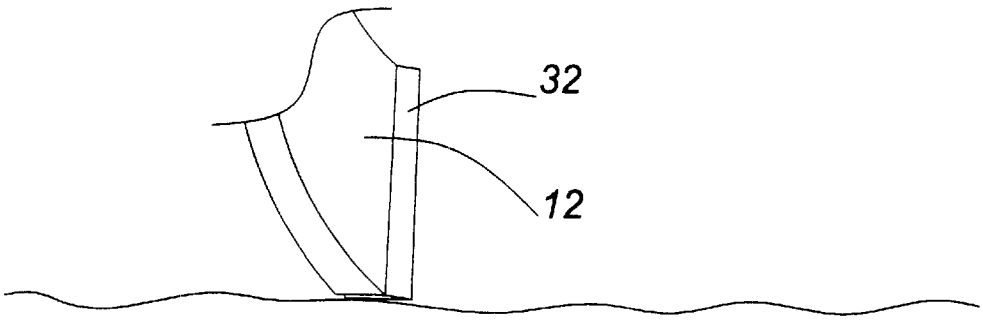
FIG. 3*a* is a partial side view of one blade of the shovel having reinforcement.

In another embodiment, the first and second ground contacting surfaces are provided with a reinforced edge 32 of metal or plastic to provide a sharper or reinforced edge as shown in FIG. 3*a*.

Further still, it is preferred that the blade 12 is provided with rounded corners 40 at the leading corner of both the first and second ground contacting surfaces to facilitate the shovel's ability to ride over imperfections in the ground which might otherwise cause the blade 12 to catch on the ground.

Still further, it is also preferred that the leading end 20 and trailing end 22 are parallel to the handle 14 to enable the blade to be placed tightly against a vertical surface at the edge of a driveway or walkway.

Figure 5:
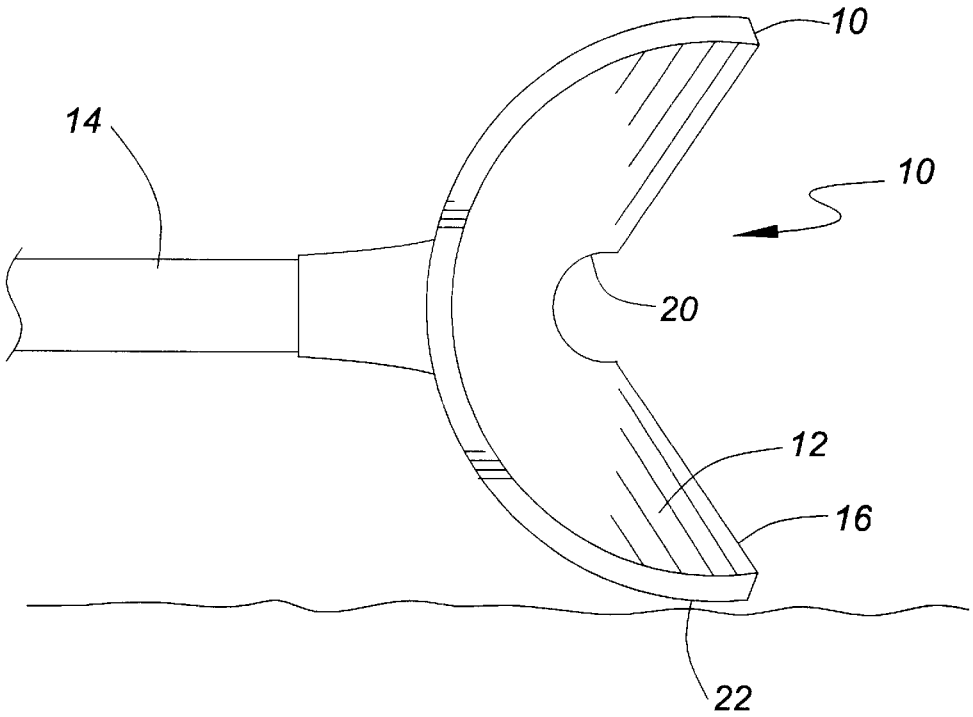
FIG. 5 is a side view of a shovel in accordance with one embodiment of the invention wherein the radius of curvature of the blade is different across the width of the blade.

In another embodiment, the blade is provided with a different or varying radius of curvature between the leading end 20 and trailing end 22 of the blade 10 as shown in FIG. 5. The radius of curvature of either a fixed or variable curvature blade will typically be in the range of 4–12 inches although these dimensions are not intended to be limiting.

Figure 7:
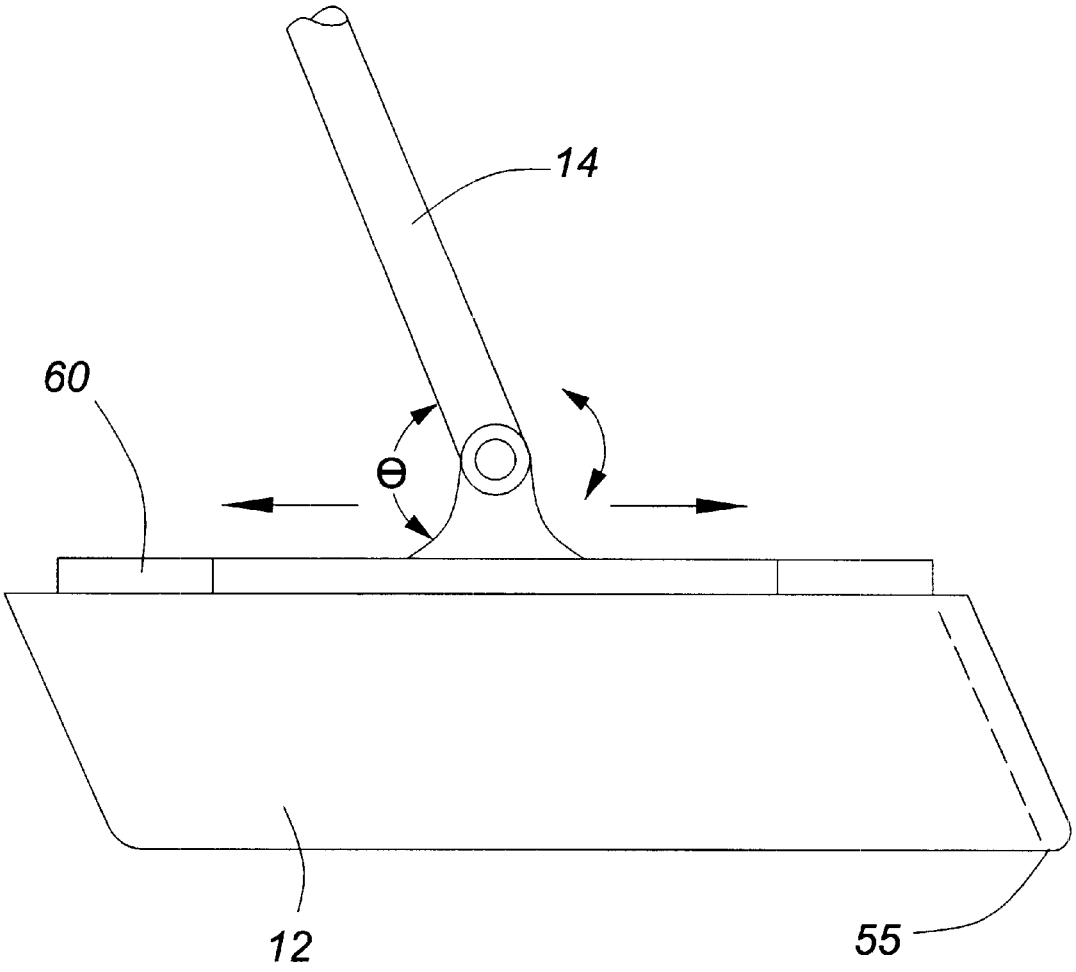
FIG. 7 is a plan view of a shovel in accordance with one embodiment of the invention wherein the position of the handle is variable with respect to the blade.

In a still further embodiment of the blade, the leading edge of the blade 20 may be provided with a cap 55 to minimize spillage of snow from the leading edge during use as shown in FIG. 7.

Figure 6:
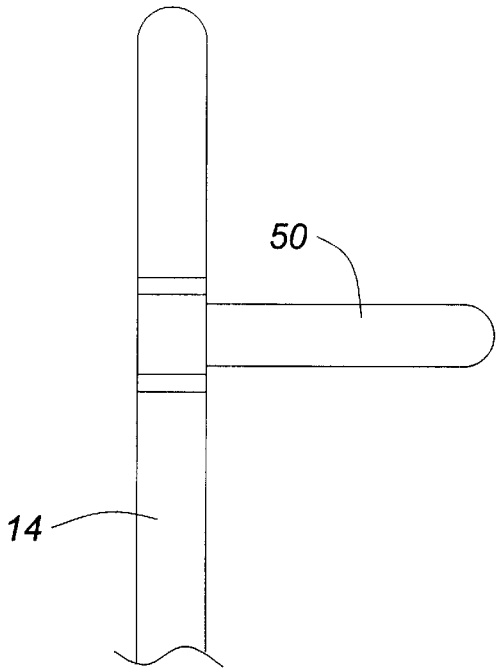
FIG. 6 is a side view of an alternate embodiment of the handle in accordance with one embodiment of the invention.

The handle 14 of the shovel 10 may have various embodiments including a straight or a bent shaft. Specific embodiments of the handle 14 may include an auxiliary handle 50 or handles to promote the ergonomics of using the shovel 10. In particular, an auxiliary handle as shown in FIG. 6 may be provided wherein the auxiliary handle 50 may rotate about the main handle 14. Other embodiments may provide one or more auxiliary handles in a fixed position.

In one embodiment as shown in FIG. 7, the angle of the blade 12 with respect to the handle 14 is adjustable (FIG. 7) enabling the user to set a particular angle for optimization of the use of the shovel depending upon the depth and characteristics of the snow. That is, in the event that the snow is deeper and/or heavier, the user may select a smaller angle θ, so as to effectively reduce the width of the blade 12 as it is pushed through the snow.

In another embodiment, the handle may be selectively offset with respect to the blade 14 by moving the handle along a track 60 on the blade 12 as shown in FIG. 7.

The shovel 10 may be manufactured from materials known to those skilled in the art including various woods, metals and plastics.

What is claimed is:

1. A hand-held shovel comprising:

a curved blade having an interior surface, an exterior surface, a leading end and a trailing end and first and second ground contacting edges;

a handle directly connected to the exterior surface of the blade midway between the first and second ground contacting edges and angled with respect to the blade;

wherein the handle and blade allow pushing operation of the shovel with either of the first and second ground contacting edges in contact with the ground.

2. A shovel as in claim 1 wherein the blade has any one of or a combination of a semi-circular, semi-elliptical or parabolic cross-section.

3. A shovel as in claim 2 wherein the blade has a radius of curvature of 4–12 inches.

4. A shovel as in claim 1 wherein the blade has a radius of curvature which varies across the width of the blade.

5. A shovel as in claim 1 wherein the blade includes a leading end and a trailing end and the handle is offset with respect to the midpoint between the leading end and trailing end.

6. A shovel as in claim 5 wherein the offset of the handle with respect to the midpoint of the blade is adjustable.

7. A shovel as in claim 1 wherein the angle of the handle is adjustable with respect to the blade.

8. A shovel as in claim 1 wherein the first and second ground contacting edges are bevelled.

9. A shovel as in claim 1 wherein the first and second ground contacting edges have first and second leading corners respectively and the first and second corners of the ground contacting edges are rounded.

10. A shovel as in claim 1 wherein the blade has first and second sides and the first and second side edges are generally parallel to the handle.

11. A shovel as in claim 1 wherein the handle includes at least one auxiliary handle projecting from the handle.

12. A shovel as in claim 1 wherein the shovel is self-supporting on the first and second ground contacting surfaces.

13. A self-supporting shovel comprising:

a curved blade having an interior surface and exterior surface, first and second ground contacting edges and a leading end and a trailing end, the curved blade having any one of or a combination of a semi-circular, semi-elliptical or a parabolic cross-section;

a handle directly connected to the exterior surface of the blade mid-way between the first and second ground contacting edges and coplanar with a first plane bisecting the curved blade and extending between the leading end and trailing end at points midway between the first and second ground contacting edges, the handle also angled with respect to the blade outside a second plane bisecting the curved blade between the first and second ground contacting edges and orthogonal to the first plane and wherein the shovel is self-supporting when the first and second ground contacting edges are simultaneously in contact with the ground.

14. A shovel as in claim 13 wherein the handle is offset with respect to the midpoint between the leading end and trailing end.

15. A shovel as in claim 14 wherein the offset of the handle with respect to the midpoint of the blade is adjustable.

16. A shovel as in claim 14 wherein the angle of the handle is adjustable with respect to the blade.

17. A shovel as in claim 13 wherein the first and second ground contacting edges have first and second leading corners respectively and the first and second corners of the ground contacting edges are rounded.

18. A shovel as in claim 13 wherein the blade has a leading end and a trailing end and the leading and trailing ends are parallel to the handle.

19. A shovel as in claim 13 wherein the handle includes at least one auxiliary handle projecting from the handle.

* * * * *